US006996239B2

(12) United States Patent
Wood

(10) Patent No.: US 6,996,239 B2
(45) Date of Patent: Feb. 7, 2006

(54) SYSTEM FOR TRANSITIONING FROM STEREO TO SIMULATED SURROUND SOUND

(75) Inventor: Bradley C. Wood, Canoga Park, CA (US)

(73) Assignee: Harman International Industries, Inc., Northridge, CA (US)

( * ) Notice: Subject to any disclaimer, the term of this patent is extended or adjusted under 35 U.S.C. 154(b) by 610 days.

(21) Appl. No.: 10/138,019

(22) Filed: May 2, 2002

(65) Prior Publication Data

US 2003/0021423 A1 Jan. 30, 2003

Related U.S. Application Data

(60) Provisional application No. 60/288,360, filed on May 3, 2001.

(51) Int. Cl.
*H04R 5/00* (2006.01)
*H04R 5/02* (2006.01)

(52) U.S. Cl. ..... 381/17; 381/18; 381/1; 381/307

(58) Field of Classification Search ..... 381/1, 381/17–18, 307
See application file for complete search history.

(56) References Cited

U.S. PATENT DOCUMENTS

| | | | |
|---|---|---|---|
| 4,394,536 | A | 7/1983 | Shima et al. |
| 5,661,808 | A | 8/1997 | Klayman |
| 5,677,957 | A | 10/1997 | Hulsebus |
| 5,870,484 | A | 2/1999 | Greenberger |

FOREIGN PATENT DOCUMENTS

EP 0 748 143 A2 12/1996

*Primary Examiner*—Laura A. Grier

(57) ABSTRACT

This invention provides a system capable of transitioning from surround sound effect to stereo sound effect, and then to a monophonic sound effect using front speakers. A user may control the amount of surround sound effect that is combined with stereo sound effect, and the amount of stereo sound effect that is combined with monophonic sound effect. The user may also control the system to hear pure surround sound effect, stereo sound effect, or monophonic sound effect. The system may allow a user to control the contribution of a particular sound effect by controlling the relative proportions of the filtered dipole signals and the attenuated unfiltered dipole signals. The signal processing may be also done through an analog device. The system may also process some audio channels in an inverted form and compensate for these inversions by reversing the polarity of that output to the speaker, as well as accept two-channel and four-channel audio inputs.

46 Claims, 9 Drawing Sheets

FIG. 1
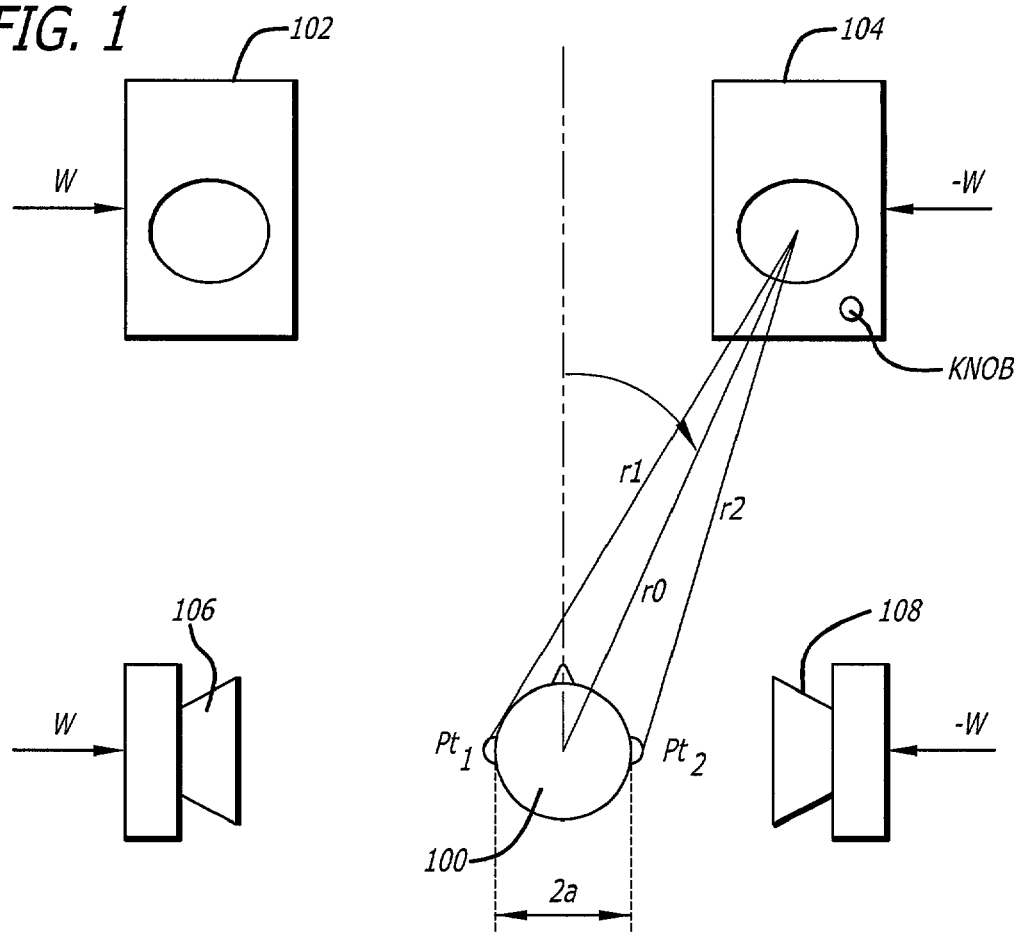
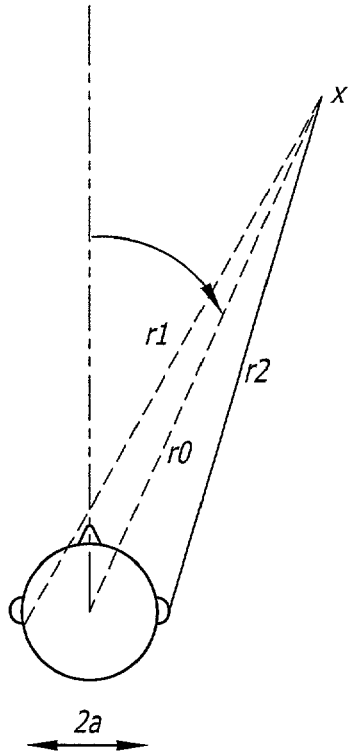
FIG. 2

SYSTEM FOR TRANSITIONING FROM STEREO TO SIMULATED SURROUND SOUND

CROSS REFERENCE TO RELATED APPLICATIONS

This application claims priority from a provisional application having Application Ser. No. 60/288,360 that was filed on May 3, 2001, and is incorporated by reference.

BACKGROUND OF THE INVENTION

1. Field of the Invention

This invention provides a system capable of gradually transitioning from stereo to ably simulated surround sound, and vice versa using front speakers.

2. General Background and State of the Art

With multi-channel audio devices, a listener has an option to hear the audio in a surround sound mode. For example, home theater systems are generally connected to front (left, right and center) and rear speakers to generate the surround sound in a listening room. For surround sound effect, rear speakers are typically needed in order to generate sound from the side or rear of the listener. If wires are not already installed in the listening area, wires need to be installed between the amplifier and the rear speakers. Installing wires for rear speakers, however, can be inconvenient and sometimes the wires can show so that they may be esthetically unpleasing.

Some have tried using just two front speakers to create a sound pressure field to simulate surround sound to eliminate the need for the rear speakers. One way to accomplish this is to filter each of the multiple left signals and the multiple right signals from the multi-channel device with appropriate ipsilateral and contralateral positional filters, to produce filtered left and right audio channels. These ipsilateral and contralateral positional filters are derived from a head related transfer function (HRTF) measured impulse response. These filters may give the listener the impression that the sound from the two front speakers are originating from virtual front and surround or rear speakers. All the left filter output signals are then summed together to make a left composite channel, and all the right channel signals are summed to make a composite right channel. Such a system also needs to cancel the cross talk associated with the left and right loudspeakers. This may be accomplished through filtering the composite left and right channels with the inverse HRTF transformation associated with the real loudspeaker positions. To calculate the inverse HRTF, measurements of the shape and size of the listener's ears (the "pinnae") and head may need to be taken. This can be a complicated process that takes time and adds cost so it may be not be a practical way to simulate surround sound effect. An average inverse HRTF may be used, but without the actual measurements of the pinnae, the quality of the simulated surround sound effect may be poor.

Another way to simulate surround sound is to use dipole and monopole pressure fields derived from point sources without having to calculate the inverse HRTF. This method models the listener's ears as two points separated by a distance 2a, where a represents the listeners head radius so that the head diffraction may not be taken into account in calculating the dipole and the monopole. However, this methodology does not include an option to hear pure stereo or a way for a listener to transition from stereo to surround sound effect, or from monophonic sound field to stereo.

Listener preferences may vary as to the amount of surround effect, and the configuration of the room can affect the sound pressure field produced by the two physical front speakers. Therefore, a need exists for a system that provides an option for a listener to control the transitions from the full surround effect to stereo, or even to monaural.

SUMMARY

This invention provides a system capable of transitioning from surround sound effect to stereo sound effect, and then to a monophonic sound effect using front speakers. A user may control the amount of surround sound effect that is combined with stereo sound effect, and the amount of stereo sound effect that is combined with monophonic sound effect. The user may also control the system to hear pure surround sound effect, stereo sound effect, or monophonic sound effect. The system may allow a user to control the contribution of a particular sound effect by controlling the relative proportions of the filtered dipole signals and the attenuated unfiltered dipole signals. The signal processing may be also done through an analog device. The system may also process some audio channels in an inverted form and compensate for these inversions by reversing the polarity of that output to the speaker, as well as accept two-channel and four-channel audio inputs.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 1 illustrates a position of a listener relative to the front speakers that are used to generate surround sound for the listener.

FIG. 2 illustrates a point source model for generating surround sound using two front speakers where a listener is given an impression that sound source is located at a certain angle from the listener.

DETAILED DESCRIPTION OF THE PREFERRED EMBODIMENTS

Figure 3:
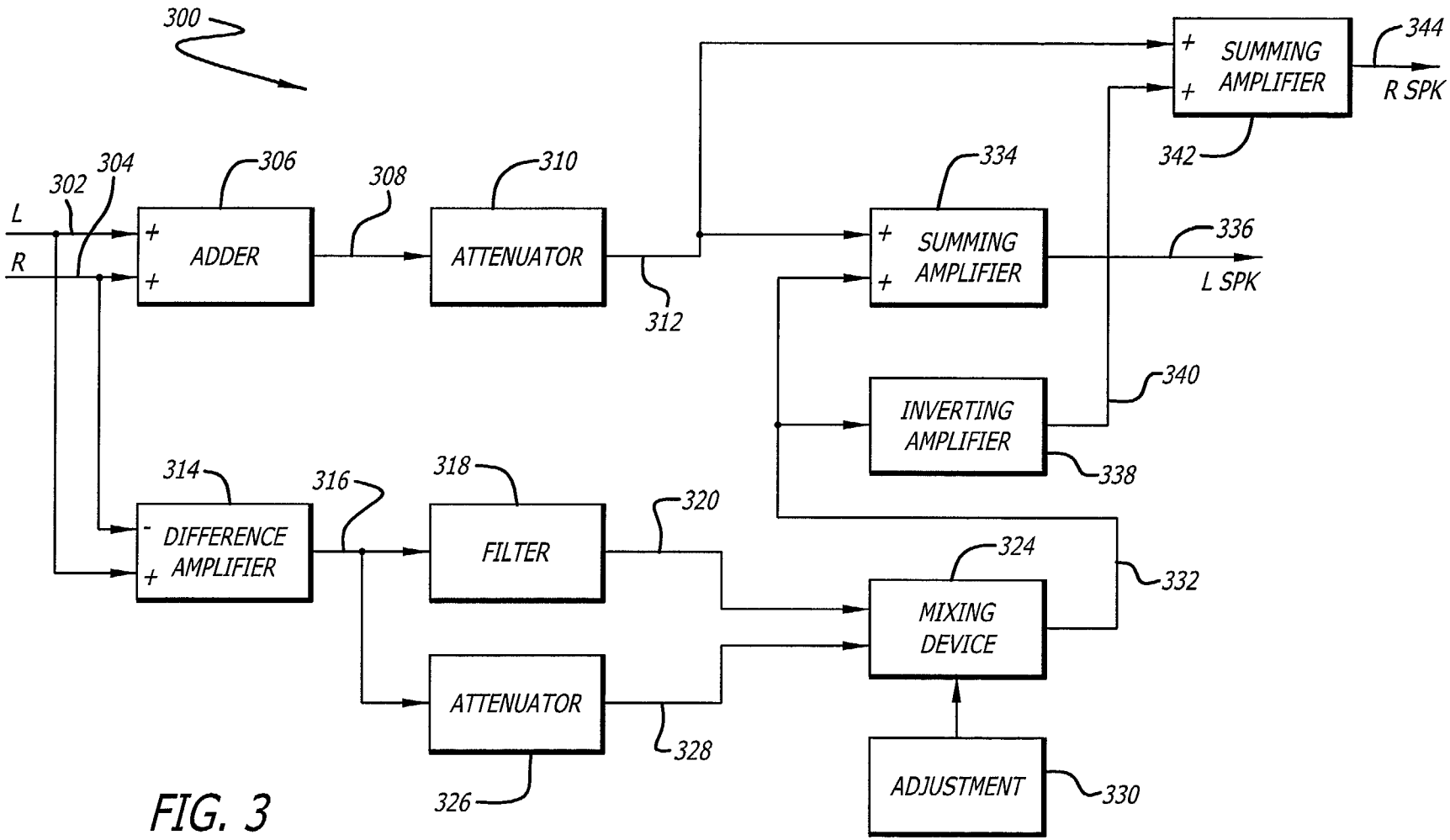
FIG. 3 illustrates a system capable of processing two audio channels to allow a user to gradually and smoothly transition between stereo and simulated surround sound using two front speakers.

Surround sound effect may be generated from the two front speakers through dipole and monopole sound fields as described in U.S. patent application Ser. No. 09/546,103 filed Apr. 10, 2000, entitled "Creating Virtual Surround Using Dipole and Monopole Pressure fields," and is incorporated by reference. FIG. 1 illustrates points $Pt_1$ and $Pt_2$ separated by a distance 2a, where a represents the radius of the listener's head 100. The distance between $Pt_1$ and the right speaker 104 may be $r_1$, and the distance between $Pt_2$ and the right speaker 104 may be $r_2$. By geometry, the left front speaker 102 and the right front speaker 104 are placed at a distance $2r_0 \sin\theta$ apart, where $r_0$ represents the center between the two points $Pt_1$ and $Pt_2$. When the left and right rear speakers 106 and 108 are positioned substantially perpendicular to the listener's ears, the motion of the surround sound from these two rear speakers may propagate substantially in a perpendicular direction to the listener's ears. Accordingly, if the two front speakers could generate the same particle motion around the listener's ears as the left and right speakers 106 and 108, the listener 100 would hear similar surround sound from just the two front speakers.

One way to generate surround sound using front speakers is to feed a signal W to the left front speaker 102 and a signal −W to the right front speaker 104 so that these two speakers may act as a dipole to cause air to move backwards and forwards between the two front speakers. This in turn may cause the air around the listener's ears to move predominately perpendicular to the listener's ears. When front speakers act as a dipole, however, there may be a frequency radiation characteristic that is different from a normal speaker, and this difference in radiation characteristic may need to be corrected. Once corrected, the listener may experience a convincing surround sound from two front speakers.

To correct for the frequency characteristics, the front speakers may be treated as a point source, then the pressure at point $Pt_1$ due to the front speakers may be described as:

$$P(Pt_1) = ve^{i\omega t}\left(\frac{e^{ikr_2}}{r_2} - \frac{e^{ikr_1}}{r_1}\right),$$

Likewise, the pressure at the point $Pt_2$ may be described as:

$$P(Pt_2) = -ve^{i\omega t}\left(\frac{e^{ikr_2}}{r_2} - \frac{e^{ikr_1}}{r_1}\right),$$

where $W=ve^{I\omega t}$; the wave number $k=\omega/c$, $\omega$ is the angular frequency, c is the speed of sound, then:

$$r_1=\sqrt{r_0^2+a^2+2ar_0\sin\theta},$$

and $$r_2=\sqrt{r_0^2+a^2-2ar_0\sin\theta}.$$

In addition, the magnitude of the pressure may be described as:

$$|\Delta_{Spk}|^{def} = |P(Pt_1)| = |P(Pt_2)|.$$

Assuming that $r_0 >> a$, i.e., that the distance between the speaker and the listener is much greater than the radius of the listener's head, then using the binomial expansion:

$$r_1 = \rho\left(1 + \frac{ar_0}{\rho^2}\sin\theta\right) + O\left(\left(\frac{a}{\rho}\right)^2\right) \tag{1.1}$$

$$r_2 = \rho\left(1 - \frac{ar_0}{\rho^2}\sin\theta\right) + O\left(\left(\frac{a}{\rho}\right)^2\right)$$

where $\rho=\sqrt{a^2+r_0^2}$. Therefore:

$$|\Delta_{Spk}(k)| = |P(Pt_1) - P(Pt_2)| = \frac{v}{\rho}\left|2j\sin\left(\frac{akr_0}{\rho}\sin\theta\right)\right| + O\left(\frac{a^2}{\rho^2}\right). \tag{1.2}$$

To determine the notches in the frequency domain, we set (1.2) to zero to get, $$|\Delta_{Spk}(k)| = 0; \Rightarrow \sin\left(\left(\frac{akr_0}{\rho}\sin\theta\right)\right) = 0$$

assuming a negligible contribution from the higher order terms.

$$\left(\frac{akr_0}{\rho}\sin\theta\right) = m\pi \Rightarrow a\sin\theta = m\frac{\rho\pi}{kr_0} = m\frac{\rho\lambda}{2r_0} \Rightarrow a\sin\theta = \frac{m\lambda}{2}$$

Assuming that $r_0 >> a$, then $\rho/r_0=1$.

Accordingly, sound with wavelengths $\lambda$ that satisfy $\lambda m=2a \sin\theta$, where m is an integer, give rise to notches in the frequency domain at the frequencies:

$$f_D = \frac{mc}{2a\sin\theta}.$$

There may be a need to compensate for these notches and for the low frequency cancellation of the dipole. This may be accomplished through inverting the transfer function through pre-filtering the signal with the inverse filter particle motion at $Pt_1$ and $Pt_2$. This may result in a very similar particle motion near the listener's ears using two front speakers as using the rear left and right speakers 106 and 108. This means that the frequency response may be compensated.

By feeding the same signals $ue^{i\omega t}$ into the left and right front speakers, the magnitude of the pressure at the points $Pt_1$ and $Pt_2$ may be expressed as:

$$|\Sigma_{Spk}|^{def} = |P(Pt_1)| = |P(Pt_2)| = |u|\left|\frac{e^{ikr_1}}{r_1} + \frac{e^{ikr_2}}{r_2}\right| \tag{1.3}$$

Using (1.1), the above equation (1.3) can be further expressed as:

$$|\Sigma_{Spk}(k)| = \frac{|u|}{\rho}\left|2\cos\left(\frac{akr_0}{\rho}\sin\theta\right)\right| + O\left(\frac{a^2}{\rho^2}\right) \tag{1.4}$$

The notches may appear for the wavelengths that satisfy $$(2m+1)\lambda=4a\sin\theta$$

Thus, the notches appear at the frequencies $$f_M = \frac{(2M+1)c}{4a\sin\theta}.$$

Here, the crosstalk of the front loudspeakers for a monophonic signal may be corrected by inverting this transfer function and using it to filter the input signal u. In other words, the crosstalk associated with the front speakers playing monophonic and out of phase signals (dipole) may be corrected. Moreover, the dipole term may cause particle motion to be substantially perpendicular to the listener's ears, and the monopole term may generate particle motion that is tangential to the listener's ears. By weighting these components, sound may be steered to a desired position.

As illustrated in FIG. 2, when a listener hears a point source $xe^{i\omega t}$, the pressure at that point $Pt_1$ may be described as:

$$P(Pt_1) = xe^{i\omega t}\frac{e^{ikR_1}}{R_1},$$

Similarly, the pressure at $Pt_2$ may be described as:

$$P(Pt_2) = xe^{i\omega t}\frac{e^{ikR_2}}{R_2}.$$

By subtracting and adding the above pressures, they may be described as the following:

$$|\Delta_R| = \left|\frac{e^{ikR_1}}{R_1} - \frac{e^{ikR_2}}{R_2}\right| \tag{1.5}$$

and

-continued $$|\Sigma_R| = \left|\frac{e^{ikR_1}}{R_1} + \frac{e^{ikR_2}}{R_2}\right|. \tag{1.6}$$

Assuming $R_0$>>a, i.e., that distance between the speaker and the listener is much greater than the radius of the listener's head, then using the binomial expansion:

$$|\Delta_R(k)| = |P(Pt_1) - P(Pt_2)| = \frac{x}{\rho}\left|2j\sin\left(\frac{akR_0}{\rho}\sin\phi\right)\right| + O\left(\frac{a^2}{\rho^2}\right) \tag{1.7}$$

and $$|\Sigma_R(k)| = |P(Pt_1) + P(Pt_2)| = \frac{x}{\rho}\left|2\cos\left(\frac{akR_0}{\rho}\sin\phi\right)\right| + O\left(\frac{a^2}{\rho^2}\right) \tag{1.8}$$

where $\rho=\sqrt{a^2+R_0^2}$. Therefore $$|\tan(ak\sin\phi)| = \frac{|\Delta_R|}{|\Sigma_R|}. \tag{1.9}$$

By decomposing the sound source into dipole and monopole terms, the ratio of the magnitudes of dipole and monopole may be described as proportional to the direction of the sound. Moreover, the frequencies of the notches may be related to the direction of the sound. The net sound pressure at the listener's ears may, in effect, add and subtract these signals, and allow the listener to detect the variations in the comb frequency behavior above. A listener noticing thusly the frequency location of these notches, in accordance with their effect on program material, may perceive an apparent direction for the origin of the sound. This is because a physical sound source in that apparent direction would produce similar net sound pressure at the listener's ears.

Using two speakers to give the impression that the sound is emanating from the direction $\phi$ the system may compensate for the cross talk associated with the dipole and monopole signals from the two speakers. To accomplish this, the system divides the dipole term by $[\Delta_{Spk}]$ and the monopole term by $[\Sigma_{Spk}]$ to obtain:

$$\Delta = \frac{\Delta_R}{[\Delta_{Spk}]} \tag{1.10}$$

and $$\Sigma = \frac{\Sigma_R}{[\Sigma_{Spk}]}. \tag{1.11}$$

Accordingly, this system creates the effect that the sound is emanating from the angle $\phi$ when the stereo loudspeakers are at $\pm\theta$, by feeding the left front speaker with the signal:

$$R_{Spk}=\Sigma+\Delta \tag{1.12}$$

and the right front speaker with the signal:

$$R_{Spk}=\Sigma-\Delta. \tag{1.13}$$

FIG. 3 illustrates a system 300 capable of gradually transitioning between stereo and surround sound from two front speakers, and vice versa. The left channel 302 and the right channel 304 may be inputs from a stereo program source. The channels 302 and 304 may also represent the rear channel inputs from a four-channel or greater-number-of-channel source. The two channels 302 and 304 may be fed to an adder 306 to produce a monopole signal 308 substantially equal to (L+R). The adder 306 may be any device or step that adds the signals from the two channels 302 and 304 together, such as a summing amplifier. The monopole signal 308 may be fed to a first attenuator 310 that may apply a gain factor $g_2$ to produce a signal $g_2$(L+R) 312.

The channels 302 and 304 may be also fed to a subtractor 314 to produce a dipole signal 316 substantially equal to (L−R). The subtractor 314 may be any device or step that subtracts channel 304 from channel 302, such as a difference amplifier. The dipole signal 316 may be applied to a filter 318 and an attenuator 326. The filter 318 may apply a transfer function H(ω) that passes signals with low frequencies without attenuation, but signals with high frequencies pass with a constant attenuation. For example, the filter 318 may be a first-order all-pass filter where frequencies above a certain frequency are progressively attenuated at a rate approaching 6 dB per octave near the center of the response slope, then the rate of attenuation may decrease asymptotically to zero. A variety of linear time-invariant filters may be used, such as first-order shelving filters, or more complex filters. The filtered (L−R) dipole signal 320 may be fed to a mixing device 324.

The dipole signal 316 may be also fed to a second attenuator 326 that may apply a gain $g_1$ to the dipole signal 316. The gain applied by the second attenuator 326 may be substantially similar to the magnitude of the response in the high frequency region of the filter 318, where the attenuation may be substantially constant with increasing frequency. The second attenuator 326 may output an attenuated (L−R) signal 328 that may be also fed to the mixing device 324.

The mixing device 324 may take the two input signals 320 and 328, and output a signal 332 that is a sum of fraction x of the input signal 320 and fraction (1−x) of the input signal 328, where $0 \leqq x \leqq 1$. Put differently, the output signal 332 may be substantially equal to x times the filtered (L−R) signal 320 plus (1−x) times the attenuated (L−R) signal 328. The mixing device 324 may be any device or process such as a potentiometer where the fractions x and (1−x) may be determined by the mechanical position of the wiper of the potentiometer. The wiper may be adjusted by a listener to mix the two signals 320 and 328. The mixing device 324 may also be an electronic potentiometer where the currents representing the two inputs may be "steered" by an appropriate arrangement of transistors to pass the desired fractions of the two input signals 320 and 328. A listener may adjust a control voltage or control current to determine the respective amount of the two input signals 320 and 328. Another way is to use two voltage-controlled amplifiers (not shown) to amplify each of the two input signals 320 and 328 and then sum the amplifier outputs in an adder, where the amplifier control voltages may be generated so that the gain of the first amplifier is x and the second amplifier is (1−x). Other methodologies may be used for mixing the two output signals 320 and 328 including gating each input signal at variable ultrasonic rates and variable duty ratios and summing the gated signals so that the audio frequency, content in the resulting summed signal equals the sum of the desired fractions of input signals.

An adjustment device 330 may be coupled to the mixing device 324 to adjust the amount of surround sound effect. The adjustment device 330 may be a knob that sets the mechanical position of the potentiometer wiper. For example, if a listener wants to maximize the surround sound effect, then the mixing device 324 may be adjusted so that the fraction x may be set to unity or one for the filtered (L−R) signal 320, and the fraction (1−x) may be set to zero for the attenuated signal g, (L−R) 328. With this adjustment, the output signal 332 from the mixing device 324 may be substantially the input signal 320. When the output signal 332 is summed with the monopole signal 312 in a summing amplifier 334, it may produce an output signal 336 that is substantially similar to the $L_{Spk}$ signal as described above in equation (0.12). This means that the output signal 336 maximizes the surround sound effect. For the $R_{Spk}$, the (L−R) output signal 332 may be inverted by an inverter 338 so that the output signal from the inverter is a filtered (R−L) signal 340. When the inverted signal 340 is summed with monopole signal 312 by a summing amplifier 342, the adder output signal 344 may be similar to the $R_{Spk}$ signal as described above in equation (0.13). With the $L_{Spk}$ and $R_{Spk}$ substantially similar to respective equations (0.12) and (0.13), the result is a maximum surround sound effect and no stereo.

For minimizing surround sound effect, the mixing device 324 may be adjusted so that the fraction x of the filtered (L−R) signal 320 is zero. This means that the fraction (1−x) is unity for the attenuated signal $g_1$ (L−R) 328 fed to the mixing device 324 so that the output 332 is an attenuated dipole signal $g_1$ (L−R) with no filtering. When the output 332 is summed with the monopole $g_2$(L+R) signal 312 in the summing amplifier 334, the output 336 may have a cancellation of R, if $g_2=g_1$. With cancellation of R, $L_{Spk}$ may be simplified to 2 $g_2$(L) that is a scaled replica of the original L signal 302. For the $R_{Spk}$, the output $g_1$(L−R) signal 332 may be inverted by the inverting amplifier 338 to an unfiltered $g_1$(R−L) signal 340. When the signal 340 is summed with the monopole $g_2$(L+R) signal 312 by the summing amplifier 342, L may be cancelled if $g_2=g_1$, leaving $R_{Spk}$ equal to 2 $g_2$(R) that is a scaled replica of the original R signal 304. With x set to zero, two $L_{Spk}$ and $R_{Spk}$ signals 336 and 344 may be pure stereo signals. For a combination of stereo and surround sound effect, the system 300 may use the adjustment device 330 to adjust the x value between 0 and 1. This may be done so that the combination of sound effects may be adapted to the listener's environment and preferences.

A mathematical description of the above system may be stated as:

$$L_{Spk}=\alpha(\omega)(L-R)+g_1(L+R);$$

$$R_{Spk}=-\alpha(\omega)(L-R)+g_1(L+R);$$

$$\alpha(\omega)=[xH(\omega)+(1-x)g_1]$$

where $g_1$ may be the attenuator gain, and x may be amount of mixing that is done in the mixing device 324 or in the potentiometer using the adjustment device 330. For example, the "center" position of the mixing device 324 may be when x=0.5. For a single-turn rotary potentiometer, fully counterclockwise may correspond to x=0 to produce pure stereo signals, while fully clockwise turn may correspond to x=1 to produce a maximum surround sound effect.

Figure 4:
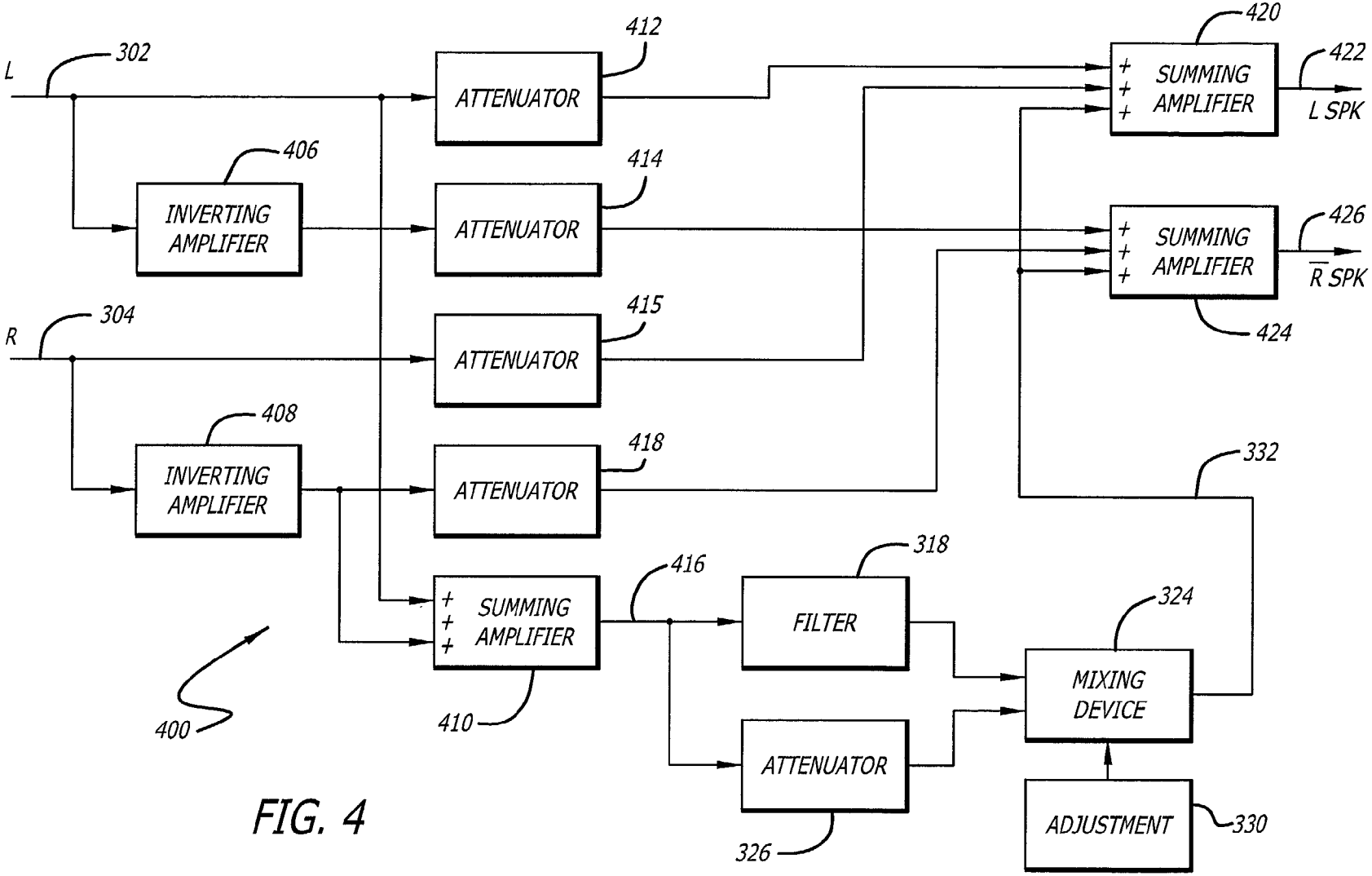
FIG. 4 illustrates another system capable of processing two audio channels to allow a user to smoothly and gradually transition between stereo and simulated surround sound using two front speakers.

FIG. 4 illustrates a system 400 that is another way of gradually transitioning between stereo and surround sound from two front speakers, and vice versa. In system 400, the left channel signals 302 may be split and fed to an inverting amplifier 406 for inverting the left channel signals 302. The right channel signals 304 may be also split and fed to an inverting amplifier 408 for inverting the right channel signals 304. With both the left and right channel signals and their inversions available, the difference amplifier 314 used to generate the dipole signal 316 in the system 300 may be replaced by a summing amplifier 410 so that the output 416 may approximate as the dipole signal 316 in FIG. 3. As such, the same filter 318, attenuator 326, mixing device 324, and adjustment device 330 may be used to generate an output signal 332 from the mixing device 324 as in FIG. 3. The output signal 332 and the output signals from attenuators 412 and 415 may be fed to a summing amplifier 420 so that the output $L_{Spk}$ signal 422 may be same as the $L_{Spk}$ signal 336 in FIG. 3. The output signal 332 and the output signals from attenuators 414 and 418 may be fed to a summing amplifier 424 so that the output $\overline{R}_{Spk}$ signal 426 may be an inversion of the $\overline{R}_{Spk}$ signal 344 in FIG. 3. The required final inversion of $\overline{R}_{Spk}$ may be accomplished at the output of the right channel power amplifier by reversing the connections to the right speaker.

Figure 5:
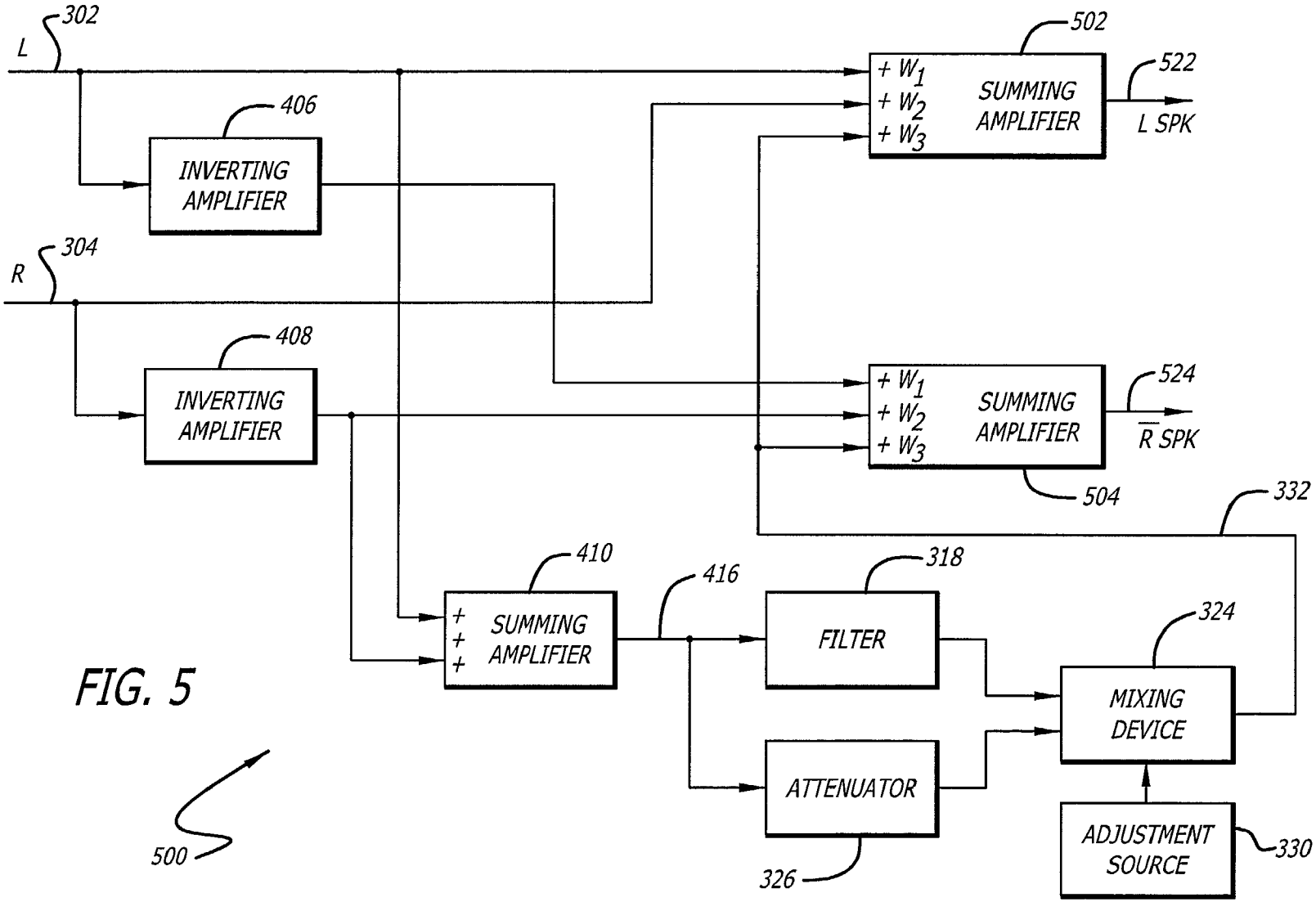
FIG. 5 illustrates a system using summing amplifiers with input weighting functions to process two audio channels to allow a user to smoothly and gradually transition between stereo and simulated surround sound using two front speakers.

FIG. 5 illustrates a system 500 that combines the operation of the attenuators and summing amplifiers in FIG. 4 into summing amplifiers 502 and 504 so that output signals 522 and 524 may be same as signals 422 and 426, respectively. This may be accomplished by adjusting the gain at the specific inputs in the summing amplifiers 502 and 504 so that the output $L_{Spk}$ signal 522 may be same as the signal 422, and the output $R_{Spk}$ signal 524 may be same as the signal 426. For example, the gain from the $+W_1$ input to the summing amplifier 502 output may be adjusted within the summing amplifier 502 to be the same as the gain from the input of attenuator 412 to the summing amplifier 420 output. Thus, the output $L_{Spk}$ signal 522 may be the same as the signal 422. The summing amplifiers 502 and 504 may make similar adjustments to other inputs so that the output signals $L_{Spk}$ and $\overline{R}_{spk}$ are same as in the system 400.

Figure 6:
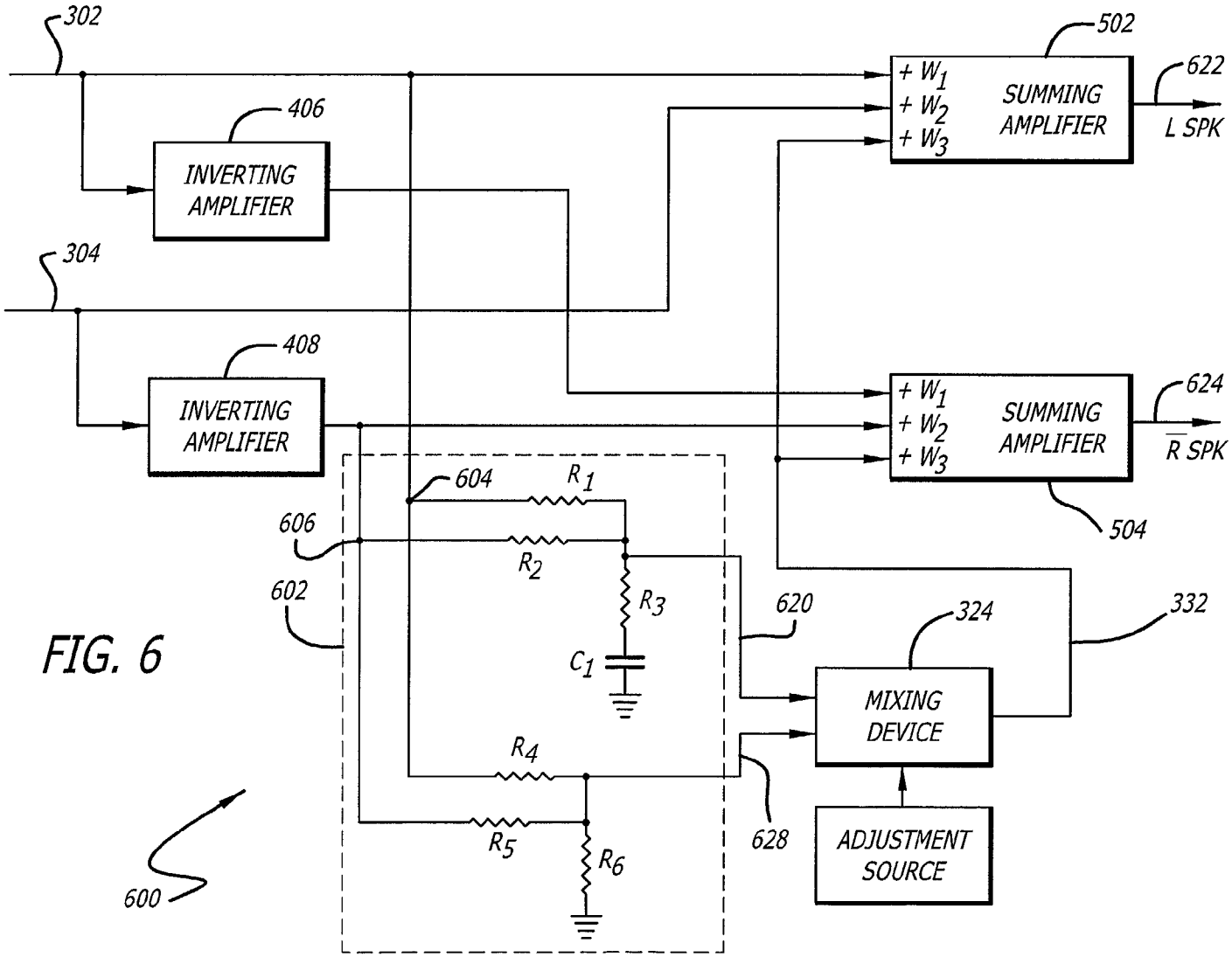
FIG. 6 illustrates a system using passive resistor-capacitor networks to process two audio channels to allow a user to smoothly and gradually transition between stereo and simulated surround sound using two front speakers.

FIG. 6 illustrates a system 600 where the operation of the summing amplifier 410, filter 318, and attenuator 326 may be combined into a network 602. The network 602 may include resistors $R_1$, $R_2$, and $R_3$, and a capacitor $C_1$, having an output signal 620 that is fed to the mixing device 324. The value for each of the resistors and the capacitor may be selected so that the output signal 620, except for a constant scaling factor, may be substantially similar as the output signal 320 that is fed to the mixing device 324 in FIG. 3. For example, when the filter 310 is a shelving filter, the magnitude of the transfer function may be described as:

$$\left[\frac{1+\omega^2/\omega_1^2}{1+\omega^2/\omega_2^2}\right]^{1/2} \text{ where } \omega_1 = \frac{1}{R_2C},\ \omega_2 = \frac{1}{R_1R_2C},$$

and $R_1$ is a single series input resistor in the shelving filter network and R2 is a resistor in series with a capacitor whose other end is tied to ground. In network 602, $R_1$ of filter 318 may be replaced with two resistors each having twice the value as $R_1$. $R_3$ of network 602 may be equal to $R_2$ of filter 310, and $C_1$ of network 602 may be equal to C of filter 318. With the outer leads for R1 and R2 connected to nodes 604 and 606, which are the left signal 302 and the inverted right signal, the signals are summed and the filter transfer function may be substantially the same except for a constant factor. Thus, the summing function of summing amplifier 410 and the filter function of filter 318 in system 400 are combined. The network 602 may also include resistors $R_4$, $R_5$, and $R_6$ that generate an output 628 that is substantially similar to the output signal 328 as in the systems 400 and 500. As such, the system 600 provides outputs $L_{Spk}$ 622 and $\overline{R}_{Spk}$ 624 that are substantially similar to outputs from the systems 400 and 500.

Figure 7:
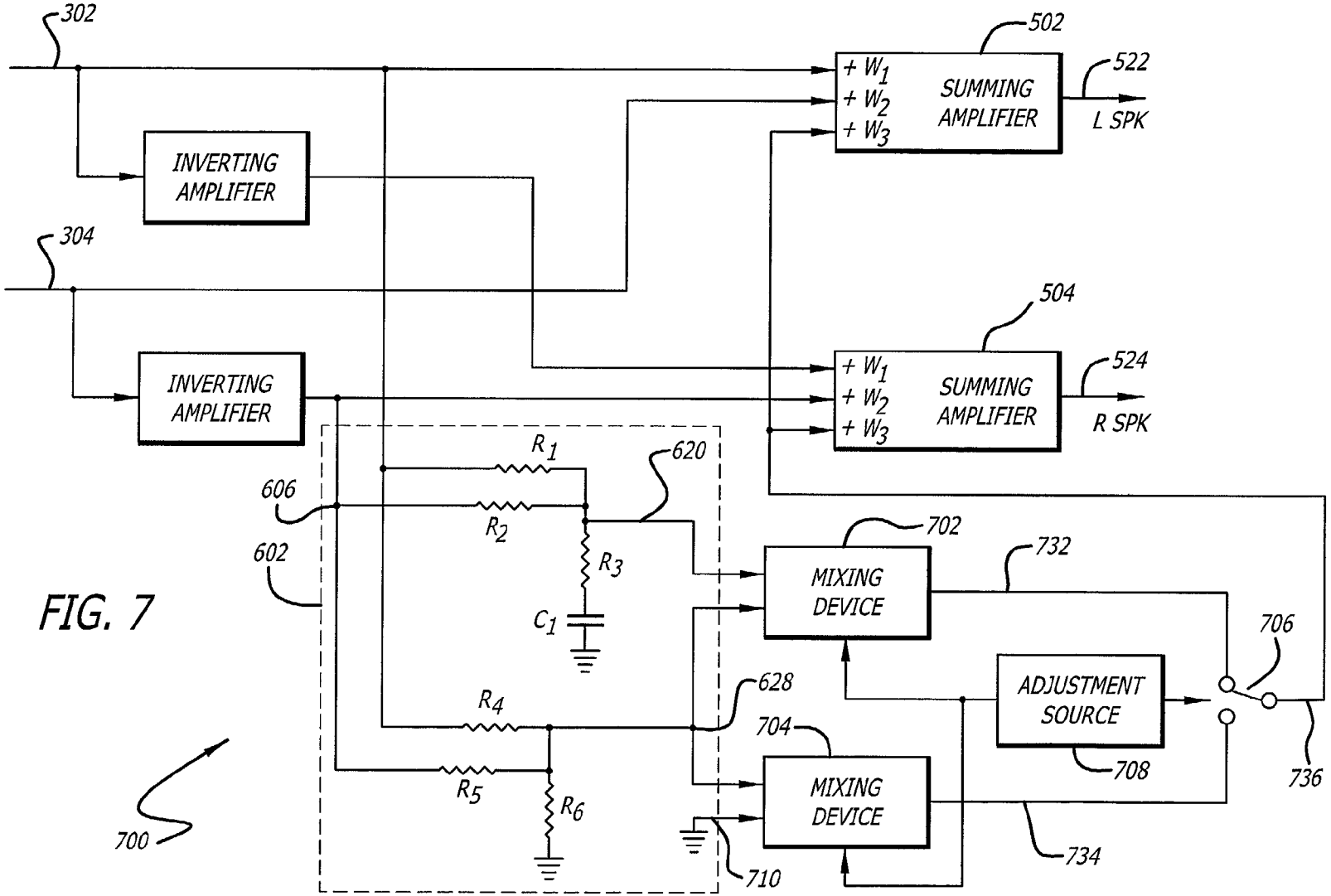
FIG. 7 illustrates a system capable of processing two audio channels to transition gradually from a monaural sound to a stereo sound and to a simulated surround sound using front speakers.

FIG. 7 illustrates a system 700 capable of transitioning gradually from a monaural sound to a stereo sound and to a virtualized surround sound field using two input channels. The system 700 may include an adjustment device 708 adapted to control a first mixing device 702, a second mixing device 704, and a switch 706. The signals 620 and 628 from the network 602 may be fed to the first mixing device 702. The output signal 732 from the mixing device 702 may be a fractional combination of the two signals 620 and 628 depending on the setting on the adjustment device 708. The signal 628 and the system common 710 may be fed to second mixing device 704. The system common 710 may be a zero signal reference point. The output 734 from the second mixing device 704 may vary depending on the setting on the adjustment device 708.

The adjustment device may include a knob that may moves between a first position and a second position with an intermediate position between the first and second positions. This may allow the adjustment device to transition between a first state and a second state, where the first state may be between the first position to the intermediate position, and the second state may be between the intermediate position and the second position. For example, the knob may be a rotary knob that may rotate fully in the right direction representing the first position and rotate fully in the left direction representing the second position, with the center point representing the intermediate position. When the knob is in the first state between the center and the right positions, the switch 706 may connect the output 732 from the first mixing device 702 to the output 736 of the switch 706. But as the knob is moved past the center point towards the second state, the switch 706 may change its state to connect the output 734 from the second mixing device 704 to the output 736.

When the adjustment device 708 is in the first state between the first and intermediate positions, the adjustment device 708 may allow the user to vary the fraction x for the signal 620 and the complementary fraction (1−x) for the signal 628 so that the first mixing device 702 may generate the output signal 732 that is a fractional combination of the two signals 620 and 628. For example, when the knob is fully in the first (right) position, x may equal 1 so that the output signal 732 may equal the output signal 620 that corresponds to a pure filtered dipole signal for a maximum surround sound effect. When the knob is in the intermediate position, however, x may equal 0 so that the output signal 732 may equal the complementary fraction (1−x), i.e., 1, of signal 628 that will produce a pure stereo signal at $L_{spk}$ and $R_{spk}$. Accordingly, when the knob in the adjustment device 708 is moved between the first and the intermediate positions, the output signal 732 having a combination of signals 620 and 628 may be passed to the output 736 of the switch 706.

As the knob in the adjustment device 708 is moved past the intermediate position towards the second state, the signal 628 may have a new fraction y of 1 and the system common or the zero signal reference 710 may have a complementary fraction (1−y) of 0, and the switch 706 may change its state to connect the output signal 734 to the output 736. As the knob is moved further to the second position, the fraction y of the signal 628 may decrease and the fraction (1−y) of the zero signal reference 710 may increase so that the output 734 from the second mixing device 704 is a fractional combination of the signals 628 and 710. When the knob is moved fully to its second position, y may be equal to 0 so that the output signal 734 may be equal to the zero signal reference 710.

The system 700 allows a user to transition gradually from a monaural sound to a stereo sound and to a virtualized surround sound field using two input channels. For example, when the knob for the adjustment device is in the intermediate position, the signal 732 may be same as the signal 628 from the network 602. The switch 706 may connect the output 732 with the output 706 so that the signal 628 that is an attenuated mixture of L and −R signals may be added to weighted (L+R) signals in the summing amplifiers 502 and 504. The summing amplifiers then produce an output 522 with an $L_{spk}$ signal, and an output 524 with $-R_{spk}$ signal so that the intermediate position of the adjustment device 708 may be same as the outputs $L_{spk}$ and $R_{spk}$ in the systems 400, 500, and 600 when they are adjusted for a pure stereo setting.

When the knob is moved past the intermediate position towards the second position, the amount of attenuated (L−R) signal at the output 736 decreases so that the outputs from the summing amplifiers 502 and 404 may smoothly approach a mixture of L+R at output 522, and −(L+R) at output 524. The polarity of the signal 524 may be inverted further down the line, for example by reversing the right speaker terminal connections. Accordingly, the system 700 allows a user to adjust the knob from the first position to the intermediate position to gradually vary from pure surround sound effect to stereo, and then adjust the knob from the intermediate position to the second position to gradually vary from pure stereo to pure monaural sound using two inputs.

Figure 8:
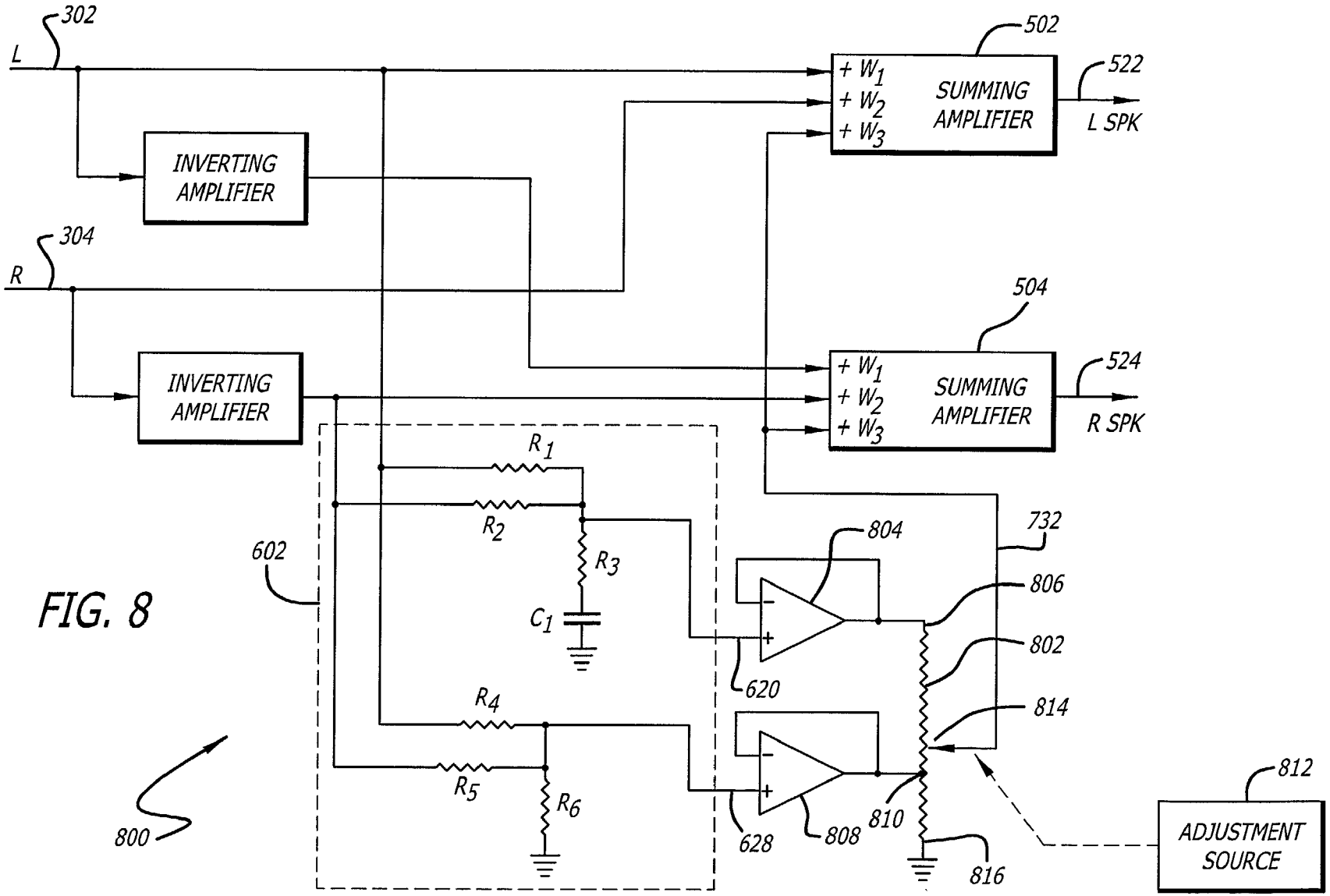
FIG. 8 illustrates a system capable of processing two audio channels using a potentiometer to transition gradually from a monaural sound to a stereo sound and to a simulated surround sound using front speakers.

FIG. 8 illustrates a system 800 capable of transitioning gradually from a monaural sound to a stereo sound and to a virtualized surround sound field using a center-tapped potentiometer 802. The potentiometer 802 may be used to perform the operations done by the first mixing device 702, the second mixing device 704, and the switch 802 in the system 700. Using potentiometer 802 may have loading effects on the signals 620 and 628 from the network 602 that may alter the frequency response of the system 800. To minimize such loading affects, a unity-gain buffer amplifier 804 may be incorporated between the signal 620 and the contact end 806, and a unity-gain buffer amplifier 808 may be incorporated between the signal 628 and the center tap 810 of the potentiometer. Alternatively, reducing the values for resistors $R_1$ through $R_6$, but increasing the value of $C_1$ may provide an acceptable loading effect so that the buffer amplifiers 804 and 808 may not be needed. Yet another way to reduce the loading effect is to adjust the end-to-end resistance of the potentiometer 802 to a higher value. A unity-gain buffer amplifier (not shown) may be also incorporated between the wiper 814 and output wire 732 to reduce the interaction between potentiometer 802 and the summing amplifiers 502 and 504. Such an interaction or loading effect may alter the dependence of amount of surround, stereo, or mono effect on the position of wiper 814 of potentiometer 802. Alternatively, the summing amplifiers 502 and 504 may be provided with high-impedance inputs to reduce the interaction with the potentiometer 802.

An adjustment device 812 may be coupled to a wiper 814 of the potentiometer 802 to vary the wiper 814 to make contact from the contact end 806 through the center tap 810 and then to the opposite end 816. As the wiper 814 makes contact with the contact end 806 of the potentiometer 802, the output signal 732 may be same as the signal fed to the summing amplifiers in the systems 400, 500, and 600, when adjusted for maximum surround sound effect. As the wiper 814 makes contact with center-tap 810, the output signal 732 may be same as the signal fed to the summing amplifiers in the systems 400, 500, and 600, when adjusted for pure stereo effect. As the wiper 814 makes contact with the opposite end 816, the output signal 732 may correspond to the pure monaural effect as in the system 700.

Figure 9:
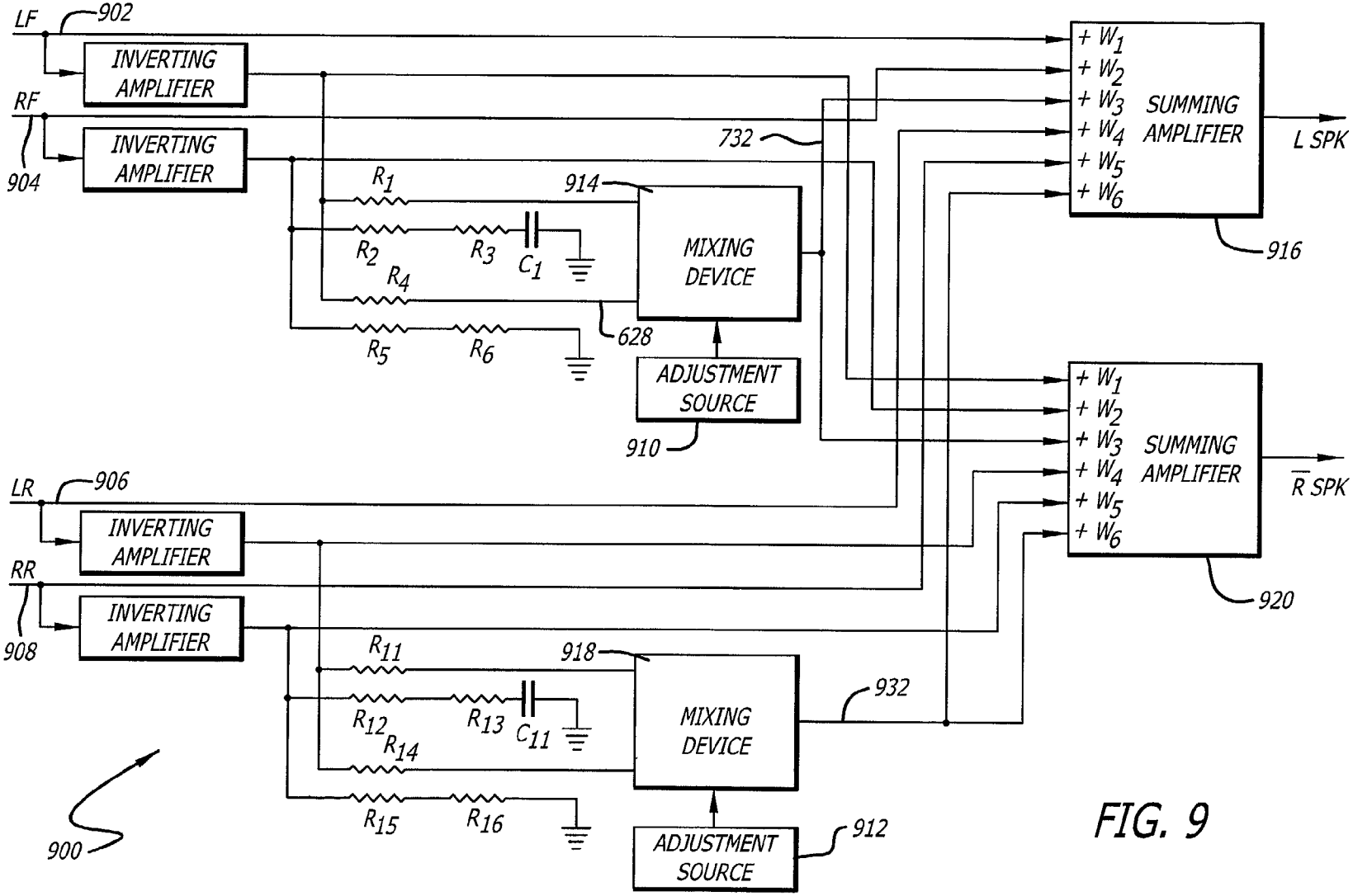
FIG. 9 illustrates a system capable of processing four audio channels to providing a smooth and gradual transition from four virtualized surround channels to a combined stereo pair output.

FIG. 9 illustrates a system 900 capable of accepting a plurality of audio inputs and generating a surround sound field near the listener's ears using two speakers that substantially resembles the sound field produced by at least four surround speakers. The system 900 may receive audio inputs Left Front 902, Right Front 904, Left Rear 906, and Right Rear 908. The audio inputs may originate from a variety of sources such as a computer sound card, a multimedia audio device, or a DVD player, where the audio inputs are generally intended to be amplified and reproduced by more than two speakers. The system 900 may process the front channels 902 and 904 in a similar manner as discussed in the systems 300 through 800. The rear channels 906 and 908 may be processed in a similar manner as well, except that the values of the attenuation and filter parameters may be determined for a larger value $\phi$ as in equations 0.7, 0.8, and 0.9, so that the virtual speakers derived from channels 906 and 908 may appear to be positioned at that larger angle.

The system 900 may allow a listener to set the adjustment devices 910 and 912 between the first position and the second position for transitioning between a virtual surround effect and a stereo effect in the front speakers. When both knobs in the adjustment devices 910 and 912 are set to the first position for a maximum surround sound effect, the signal 732 from the front mixing device 914 may be the front filtered dipole signal, and the signal 932 may be the rear filtered dipole signal. These signals may be fed to left and right summing amplifiers 916 and 920. Additional inputs to summing amplifier 916 are Left Front 902, Right Front 904, Left Rear 906, and Right Rear 908. Additional inputs to summing amplifier 920 are inverted Left Front 902, inverted Right Front 904, inverted Left Rear 906, and inverted Right Rear 908. These signals thus summed produce the Lspk signal at the output of summing amplifier 916, and the Rspk signal at the output of summing amplifier 920. The Lspk and Rspk signals may provide a surround sound effect that approximates the surround sound produced by four discrete speakers. When the knob in the adjustment devices 910 and 912 is set to the second position, the left summing amplifier 916 may produce the Lspk signal with a mixture of Front Left 902 and Rear Left 906 signals, and the right summing amplifier 920 may produce the Rspk signal with a mixture of Front Right 904 and Rear Right 908 signals. Alternatively, one adjustment device may be used to control the front and rear mixing devices 914 and 918. Thus, system 900 provides a gradual adjustment from a surround sound field approximating that produced by four discrete speakers, to a stereo field in which front and rear inputs are combined into left and right channels.

These signals when summed produce the $L_{spk}$ signal at the output of summing amplifier 916, and the $R_{spk}$ signal at the output of summing amplifier 920. The $L_{spk}$ and $R_{spk}$ signals may provide a surround sound effect that approximates the surround sound produced by four discrete speakers. When the knob in the adjustment devices 910 and 912 is set to the second position, the left summing amplifier 916 may produce the $L_{spk}$ signal with a mixture of Front Left 902 and Rear Left 906 signals, and the right summing amplifier 920 may produce the $R_{spk}$ signal with a mixture of Front Right 904 and Rear Right 908 signals. Alternatively, one adjustment device may be used to control the front and rear mixing devices 914 and 918. Thus, system 900 provides a gradual adjustment from a surround sound field approximating that produced by four discrete speakers, to a stereo field in which front and rear inputs are combined into left and right channels.

Figure 10:
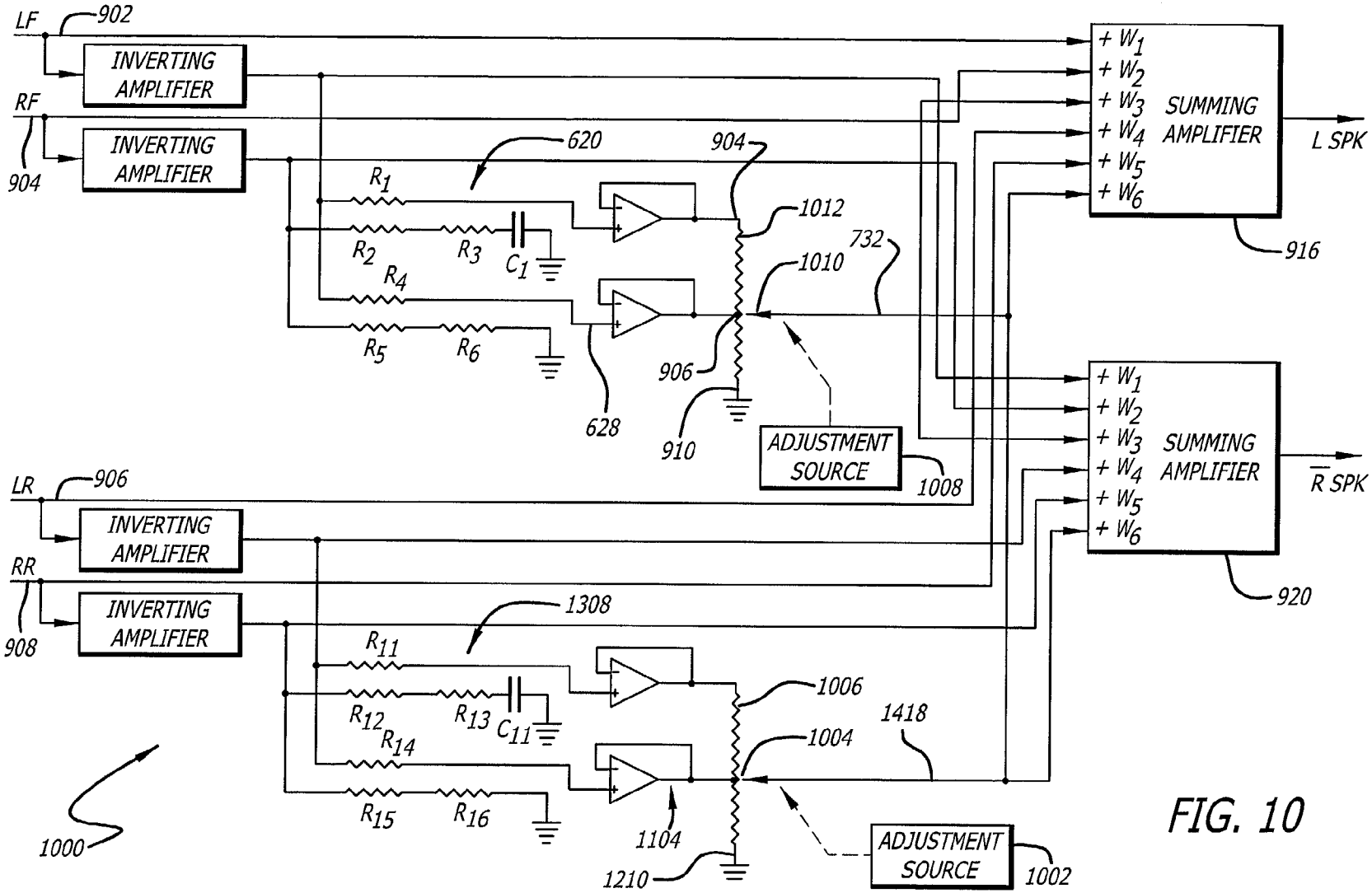
FIG. 10 illustrates a system capable of processing four audio channels and providing a smooth and gradual transition from four virtualized surround channels, to a combined stereo pair, and to a combined pure monaural sound field.

FIG. 10 illustrates a system 1000 using potentiometers for mixing signals rather than a mixing device. The system 1000 may include a rear adjustment device 1002 for controlling the position of the wiper 1004 of the potentiometer 1006, and a front adjustment device 1008 for controlling the wiper 1010 of the potentiometer 1012. Similar to the system 800, but processing four discrete input channels, the wipers 1004 and 1010 may be adjusted to provide a smooth transition from monaural to stereo, and from stereo to surround sound effect and vice versa through the outputs $L_{Spk}$ and $\overline{R}_{Spk}$. Alternatively, one adjustment device may be used to control the two potentiometers 1006 and 1012.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

The invention claimed is:

1. A transitioning system from stereo to simulated surround sound, comprising:

a filter transforming a dipole signal to a filtered dipole signal;

a first attenuator transforming the dipole signal into an attenuated dipole signal, where the filter and attenuated dipole signals are fed to a mixer that combines a fractional sum between the filtered dipole signal and the attenuated dipole signal thus generating a mixed signal;

a second attenuator transforming a monopole signal to an attenuated monopole signal;

a first adder summing the mixed signal and the first attenuated monopole signal to obtain a first speaker channel; and an inverter creating an inverted mixed signal, where the attenuated monopole signal and the inverted mixed signal are fed to a second adder summing the attenuated monopole signal and the inverted mixed signal to obtain a second speaker channel.

2. The system according to claim 1, further including an adjustment device coupled to the mixer adjusting the fractional sum between the filtered dipole signal and the attenuated dipole signal from all filtered dipole signal to all attenuated dipole signal.

3. The system according to claim 1, where the filter applies a transfer function to pass high frequency signals with a constant attenuation and pass signals with low frequencies without attenuation.

4. The system according to claim 3, where the attenuation in the first attenuator approximates the response of the transfer function in the high frequency region.

5. The system according to claim 3, where the attenuation in the second attenuator approximates the response of the transfer function in the high frequency region.

6. The system according to claim 1, where the filter is a shelving filter.

7. The system according to claim 6, where the shelving filter transfer function has a magnitude $$\left[\frac{1+\omega^2/\omega_1^2}{1+\omega^2/\omega_2^2}\right]^{1/2}, \text{ where } \omega_1 = \frac{1}{R_2C}, \omega_2 = \frac{1}{R_1R_2C},$$

and $R_1$ is a single series input resistor in the shelving filter, and $R_2$ is a resistor in series with the capacitor C that has one end tied to a ground.

8. The system according to claim 1, where the mixing device is a potentiometer having a first end and a second end being a ground, the potentiometer having a wiper so that when the wiper makes contact with the first end of the potentiometer that corresponds to a maximum surround sound effect, when the wiper makes contact with the second end of the potentiometer that corresponds to a maximum monaural effect, and when the wiper makes contact with the potentiometer at a predetermined position between the first and second ends of the potentiometer that corresponds to a maximum stereo effect.

9. The system according to claim 1, where the dipole signal is generated from a difference amplifier that subtracts a right channel signal from a left channel signal.

10. The system according to claim 1, where the dipole signal is generated from a summing amplifier that adds a left channel signal to an inverted right channel signal.

11. A system for summing signals from left and right audio channel inputs when transitioning from stereo to simulated surround sound, comprising:

a first summing amplifier adapted to receive a left audio signal, a right audio signal, and a mixed signal that is a fractional sum between a filtered dipole signal and an attenuated dipole signal, where the first summing amplifier adjusts a gain for each of the left audio signal, the right audio signal, and the mixed signal to generate a left speaker signal; and a second summing amplifier adapted to receive an inverted left audio signal, an inverted right audio signal, and the mixed signal, where the second summing amplifier adjusts a gain for each of the inverted left audio signal, the inverted right audio signal, and the mixed signal to generate a right speaker signal so that the left and right speaker signals generate a combination of stereo and simulated surround sound from left and right speakers, respectively.

12. The system according to claim 11, where the mixed signal is provided by a mixing device that combines a filtered dipole signal and an attenuated dipole signal, where the dipole signal is the left audio signal minus the right audio signal.

13. The system according to claim 12, further including an adjustment device coupled to the mixing device to adjust a fractional sum between the filtered dipole signal and the attenuated dipole signal from all filtered dipole signal to all attenuated dipole signal.

14. A system capable of transitioning from stereo to simulated surround sound, comprising:

a first filter receiving a left audio signal and an inverted right audio signal and output a filtered dipole signal and an attenuated dipole signal;

a first mixing device receiving the filtered dipole signal and the attenuated dipole signal and providing a first mixed signal that is a fractional sum between the filtered dipole signal and the attenuated dipole signal;

a first summing device receiving a left audio signal, a right audio signal, and the first mixed signal, where the first summing adds each of the signals to produce a left speaker signal; and a second summing device receiving an inverted left audio signal, an inverted right audio signal, where the second summing device adds each of the signals producing a right speaker signal so that the left and right speaker signals generate a combination of stereo and simulated surround sound from left and right speakers, respectively.

15. The system according to claim 14, where the first filter is a shelving filter.

16. The system according to claim 15, where the shelving filter has a transfer function with a magnitude response $$\left[\frac{1+\omega^2/\omega_1^2}{1+\omega^2/\omega_2^2}\right]^{1/2}, \text{ where } \omega_1 = \frac{1}{R_2C}, \omega_2 = \frac{1}{R_1R_2C},$$

and $R_1$ is a single series input resistor in the shelving filter, and R2 is a resistor in series with the capacitor C that has one end tied to a ground.

17. The system according to claim 14, further including an adjustment device coupled to the first mixing device to adjust the fractional sum between the filtered dipole signal and the attenuated dipole signal so that the first mixed signal transition between all filtered dipole signal corresponding to simulated surround sound and all first attenuated dipole signal corresponding to stereo sound.

18. The system according to claim 14, where the first filter applies a transfer function to pass high frequency signals with a constant attenuation and pass signals with low frequencies without attenuation.

19. The system according to claim 14, where the mixing device is a potentiometer having a first end and a second end being a ground, the potentiometer having a wiper so that when the wiper makes contact with the first end of the potentiometer, that corresponds to a maximum surround sound effect, when the wiper makes contact with the second end of the potentiometer, that corresponds to a maximum monaural effect, and when the wiper makes contact with the potentiometer at a predetermined position between the first and second ends of the potentiometer, that corresponds to a maximum stereo effect.

20. The system according to claim 14, where when the wiper transitions from the first end to a predetermined position the first mixed signal corresponds to a transition from surround sound effect to stereo sound, when the wiper transitions from the predetermined position to the second end the first mixed signal corresponds to a transition from stereo sound to monaural sound.

21. A method for transitioning from stereo to simulated surround sound, comprising:

filtering a dipole signal from an audio source generating a first filtered dipole signal;

applying a first gain to the dipole signal generating a first attenuated dipole signal and a second gain to a monopole signal from the audio source generating a first attenuated monopole signal;

mixing a fractional sum between the first filtered and first attenuated dipole signals generating a mixed signal;

summing the first attenuated monopole and mixed signal to obtain a first speaker channel; and summing an inverted mixed signal and the first attenuated monopole signal to obtain a second speaker channel.

22. The method according to claim 21, further adjusting the fractional sum between the first filtered and attenuated dipole signals generating the mixed signal that corresponds to a transition from simulated surround sound to stereo sound.

23. The method according to claim 22, where the filtering applies a transfer function to pass high frequency signals with relatively constant attenuation and pass signals with low frequencies without attenuation.

24. The method according to claim 21, where the first gain and the second gain are approximately equal.

25. The method according to claim 23, where the attenuation in the second attenuator is approximately equal to the response of the transfer function in the high frequency region.

26. The method according to claim 21, where the filter is a shelving filter.

27. The method according to claim 26, where the shelving filter has a transfer function with a magnitude response $$\left[\frac{1+\omega^2/\omega_1^2}{1+\omega^2/\omega_2^2}\right]^{1/2}, \text{ where } \omega_1 = \frac{1}{R_2C}, \quad \omega_2 = \frac{1}{R_1R_2C},$$

and $R_1$ is a single series input resistor in the shelving filter, and $R_2$ is a resistor in series with the capacitor C that has one end tied to a ground.

28. The method according to claim 21, where the mixing is performed by a potentiometer having a first end and a second end being a ground, the potentiometer having a wiper that corresponds to a maximum surround sound effect when the wiper makes contact with the first end of the potentiometer; and corresponds to a maximum monaural effect when the wiper makes contact with the second end of the potentiometer; and corresponds to a maximum stereo effect when the wiper makes contact with the potentiometer at a predetermined position between the first and second ends of the potentiometer.

29. The method according to claim 21, where the dipole signal is generated by subtracting a right channel signal from a left channel signal.

30. The method according to claim 21, where the dipole signal is generated from a summing amplifier that adds a left channel signal to an inverted right channel signal.

31. The method according to claim 21, further including:

mixing a zero reference signal and the first attenuated dipole signal to provide a second mixed signal;

transitioning between a first state and a second state, where the first state the first mixed signal is passed to the step of summing, and in the second state the second mixed signal is passed to the step of summing, where the first mixed signal is adjustable from surround sound effect to stereo sound, and the second mixed signal is adjustable from stereo sound to monaural sound.

32. A signal processing system capable of summing left and right audio channel inputs enabling a transition from stereo to simulated surround sound, comprising:

summing a left audio signal, a right audio signal, and a mixed signal, where the mixed signal is a fractional sum between a filtered dipole signal and an attenuated dipole signal, adjusting a first gain at each of the left audio signal, the right audio signal, and the mixed signal generating a left speaker signal;

summing an inverted left audio signal, an inverted right audio signal, and the mixed signal; and adjusting a second gain at each of the inverted left audio signal, the inverted right audio signal, and the mixed signal generating a right speaker signal so that the left and right speaker signals generate a combination of stereo and simulated surround sound from left and right speakers, respectively.

33. The method according to claim 32, further mixing a filtered dipole signal and an attenuated dipole signal providing the mixed signal to the step of summing.

34. The method according to claim 32, further adjusting the mixing so that a fractional sum between the filtered dipole signal and the attenuated dipole signal transitions from all filtered dipole signal to all attenuated dipole signal, where the all filtered dipole signal corresponds to all simulated surround sound, and all attenuated dipole signal corresponds to all stereo sound.

35. A system capable of transitioning from stereo to simulated surround sound, comprising:

a first mixing device receiving a filtered dipole signal and an attenuated dipole signal and providing a first mixed signal that is a fractional sum between the filtered dipole signal and the attenuated dipole signal, when the fractional sum of the first mixed signal is adjusted to increase the filtered dipole signal into the first mixed signal, sound generated from front speakers based on the first mixed signal transitions to increase simulated surround sound versus stereo sound.

36. The system according to claim 35, further including a first filter receiving a dipole signal to provide the filtered dipole signal.

37. The system according to claim 36, where the dipole signal is from a difference amplifier that subtracts a right channel signal from a left channel signal.

38. The system according to claim 36, where the dipole signal is from a summing amplifier that adds a left channel signal to an inverted right channel signal.

39. The system according to claim 36, where the first filter is a shelving filter.

40. The system according to claim 39, where the shelving filter has a transfer function with a magnitude response $$\left[\frac{1+\omega^2/\omega_1^2}{1+\omega^2/\omega_2^2}\right]^{1/2}, \quad \text{where } \omega_1 = \frac{1}{R_2C}, \quad \omega_2 = \frac{1}{R_1R_2C},$$

and $R_1$ is a single series input resistor in the shelving filter, and R2 is a resistor in series with the capacitor C that has one end tied to a ground.

41. The system according to claim 36, further including an adjustment device coupled to the first mixing device to adjust the fractional sum between the filtered dipole signal and the attenuated dipole signal so that the first mixed signal transition between all filtered dipole signal corresponding to simulated surround sound and all first attenuated dipole signal corresponding to stereo sound.

42. The system according to claim 36, where the first filter applies a transfer function to pass high frequency signals with a constant attenuation and pass signals with low frequencies without attenuation.

43. The system according to claim 36, further including an adjustment device coupled to the first mixing device and a second mixing device, where the second mixing device is coupled to a system ground and is adapted to receive the attenuated dipole signal, where the adjustment device is adapted to transition between a first state and a second state, where in the first state the adjustment device pass the first mixed signal from the first mixing device that is the fractional sum between the filtered dipole signal and the attenuated dipole signal to first and second summing devices, where in the second state the adjustment device pass a first mixed signal from the second mixing device that is a fraction sum between the attenuated dipole signal and a zero signal reference from the system common to the first and second summing devices.

44. The system according to claim 36, where the first mixing device is a potentiometer having a first end and a second end being a ground, the potentiometer having a wiper so that when the wiper makes contact with the first end of the potentiometer that corresponds to a maximum surround sound effect, when the wiper makes contact with the second end of the potentiometer that corresponds to a maximum monaural effect, and when the wiper makes contact with the potentiometer at a predetermined position between the first and second ends of the potentiometer that corresponds to a maximum stereo effect.

45. The system according to claim 35, further including:

a first summing device receiving a left audio signal, a right audio signal, and the first mixed signal, where the first summing device adds each of the signals to produce a left speaker signal; and a second summing device receiving an inverted left audio signal, an inverted right audio signal, where the second summing device adds each of the signals to produce a right speaker signal so that the left and right speaker signals generate a combination of stereo and simulated surround sound from the left and right speakers, respectively.

46. The system according to claim 35, further including:

a first attenuator transforming a dipole signal into the attenuated dipole signal;

a second attenuator transforming a monopole signal into an attenuated monopole signal;

a first summing device adding the first mixed signal and the first attenuated monopole signal to obtain a first speaker channel; and an inverter creating a first inverted mixed signal, where the attenuated monopole signal and the first inverted mixed signal are fed to a second summing device to add the attenuated monopole signal and the first inverted mixed signal to obtain a second speaker channel.

* * * * *